United States Patent [19]

Tsukumo et al.

[11] Patent Number: 4,511,102

[45] Date of Patent: Apr. 16, 1985

[54] BOBBIN HOLDER

[76] Inventors: Zenzaburo Tsukumo; Masae Tsukumo; Shinsuke Tsukumo, all of 5-5, Sakuradai 3-chome, Nakayama, Takarazuka, Hyogo 665, Japan

[21] Appl. No.: 474,679

[22] PCT Filed: Jun. 16, 1981

[86] PCT No.: PCT/JP81/00140

§ 371 Date: Feb. 16, 1983

§ 102(e) Date: Feb. 16, 1983

[87] PCT Pub. No.: WO82/04433

PCT Pub. Date: Dec. 23, 1982

[51] Int. Cl.[3] ..... B65H 49/02; D03J 5/08

[52] U.S. Cl. ..... 242/130.2; 242/129.7

[58] Field of Search ..... 242/129.5, 129.7, 130.2, 242/136; 68/198, 212; 57/90, 127.5, 127.7

[56] References Cited

U.S. PATENT DOCUMENTS

| | | | |
|---|---|---|---|
| 3,743,211 | 7/1973 | Imai et al. | 242/103.2 |
| 3,877,659 | 4/1975 | Takata | 242/130.2 |
| 4,015,797 | 4/1977 | Tsukumo | 242/103.2 |
| 4,052,021 | 10/1977 | Tsukumo | 242/130.2 |

*Primary Examiner*—Leonard D. Christian
*Attorney, Agent, or Firm*—Armstrong, Nikaido, Marmelstein & Kubovcik

[57] ABSTRACT

A bobbin holder including a hanging member suspended from an upper suspending structure and rotatable around a center axis with a cylindrical outer surface, a chamber, three guide grooves, and three rockably supporting portions. The three guide grooves open into the chamber and extend in a direction of the axis. The guide grooves are arranged radially and symmetrically with respect to the axis. Three rockable elements are rockable in a limited range outwardly and inwardly around the bottom portions thereof through the guide grooves. Each rockable element has a triange-like profile and a bottom portion supported with the rockably supported portion. An upper outside surface of each rockable element is formed as an inclined shoulder and an upper inside surface of each element is formed as an engaging surface. The upper outside surfaces are arranged when in the outward position along a conical surface of an imaginary cone having a top angle of 60 to 90 degrees. A core element is contained in the chamber and is shiftable along the center axis. Structure is provided for locking the core member in an upper shifted position or a lower shifted position so that when in the lower position the core member engages with the engaging surfaces of the rockable elements in order to hold the same opened outwardly and when the core member shifted into the upper position the core member is disengaged from the engaging surfaces in order to allow the rockable elements to rock freely.

4 Claims, 13 Drawing Figures

BOBBIN HOLDER

TECHNICAL FIELD OF THE INVENTION

The present invention relates to a bobbin holder for use mainly in a creel of a textile machine, particularly a spinning frame or a roving frame. Further, the present invention can widely apply not only to a textile machine, but also to general industrial machines by applying and the developing this theory as the following illustration. There is a possibility that a distinguished merit of the rationalization is obtained when it is applied to an automatic warehouse, a successive transfer device, an automatic packing device, and the like.

BACKGROUND ART

A bobbin holder is one of key parts of a textile machine which is recently in general use. In the bobbin holder, a bobbin is inserted from the lower side of a hanging member of the bobbin holder. A pair of rockable elements separating right and left, which are contained in an inner portion of a hollow in the hanging member, are opened and projected in the right and left lateral direction. A shoulder of the bobbin is engaged with the rockable elements. When the bobbin is doffed from the bobbin holder, the projecting rockable elements automatically draw back into the hanging member in response to the doffing operation of the bobbin from the hanging member. Accordingly, the bobbin creel is simplified, and donning and doffing of the bobbin becomes easier.

All types of bobbin holders conventionally used are articles which suspend bobbins at two points by means of a pair of rockable elements. Accordingly, the support of the bobbin becomes unstable. It is difficult to keep the bobbin suspended and aligned with the center line of the hanger. Thus when the roving is withdrawn, the rotation of the bobbin is not smooth.

That is to say, movements of the bobbin such as eccentric rotation or precession are caused, so that the tension in the roving becomes uneven. For this reason, unevenness of yarn and breakage of roving occur. For preventing such, it is necessary to use a conical structure as an aligning compensating wedge jointly with the hanging member. However, the effect is not precise.

DISCLOSURE OF THE INVENTION

The present invention relates to a bobbin holder which is fundamentally improved in construction and structure by considering the disadvantages of those conventional bobbin holders. The key point of the invention is the reform of fundamental structure to provide a self-aligning system which aligns the rotational axes of constituent elements to a predetermined vertical axis by a self-balancing action caused by gravitation when the bobbin holder is in working under full load. That is, a self-aligning suspension system is provided with similar radial three-point bobbin support using blades.

The effects of the present invention which are greatly excellent in comparison with that of the conventional bobbin holder are as follows:

(1) A bobbin is vertically suspended with certainty by the bobbin holder which has a sensitive and proper self-aligning function. In this manner, the bobbin is smoothly rotated around the center axis of the bobbin holder without producing improper rotation such as eccentric rotation or precession corresponding to the draw-out velocity of roving. Accordingly, the tension of the roving remains even and the bobbin holder of the present invention can satisfactorily prevent the occurance of unevenness of yarn or breakage of roving.

(2) The three-point support using a set of rockable elements has the same effect as the three-point supporting system using balls which is a sister article of the present system, and it can be considered that they are the same in the point of self-aligning function. In the rockable opening-closing system, as its merit, it is possible to enlarge the projecting length of the rocking members projecting from the outer surface of a cylinder of a hanging member. Therefore, it is commonly and generally applicable to every size of the bobbin bore in comparison with the three-point bobbin supporting system using balls. Also, it has the same quality, intensity and endurance as the three-point supporting system using balls even with a marked increase in size of packages and severe operating conditions.

(3) A rockable element can be manufactured by several methods and the freedom of payability and economical efficiency at the case of the mass production is broadened by various methods such as plastic molding, alloy-sintering and press forming depending on the uses. Also, the forming of the hanging member is greatly simplified, so that a cost for the mass production is greatly decreased.

(4) In case that the center axis around which the rockable elements are swung is located in the lowest portion of the hanging member, the invention is useful for improving the essential characteristics such as certainty of working of the set of the rockable elements, continuation of accuracy, intensity, endurance and safety coefficiency against load, and the safety and reliability progress greatly in comparison with the conventional article. For example, the critical value of the suspendable load is certainly increased several times in comparison with that of conventional articles and the endurance is increased above double in comparison with that of conventional articles.

(5) In case where a core consists of two members, reliability in changing a clutch is greatly improved and the remarkable effect on safety of donning and doffing operation of the bobbin is obtained. Also, accidental mis-change of the clutch which sometimes irregularly occurs in the case of the conventional three-point supporting system using balls, is eliminated by employing the dual-construction of the core. Further, the projecting length of the rockable elements can be optionally easily changed by changing the diameter of the core for controlling the rockable elements.

(6) In connection with altering an upper structure into self-aligning suspension system, the synergistic effect causing, as a whole, from working of the balancing aligning elements in the present invention, e.g. the control system for the rockable elements, the proper shape and construction of a cone-like inclined sliding contact surface for suspension, and the like, is a remarkably excellent feature of the present invention and conduces to much increase of damping function in suspension of the bobbin holder. As a result of this, "the metal member made in the form of the inverse conical shape for adjusting a centering" which is indispensable for the conventional article using two rockable elements, becomes useless. Moreover, if there is some superabundant clearance between the internal diameter of the inserting bore of the bobbin and the external diameter of the hanging member, the self-aligning function is not affected at all.

(7) Further, by forming a bearing structure of the present invention in a bearing structure having double bearing portions which are provided similarly and symmetrically to a pivot having two symmetrical end portions, one of the most important functions of a bobbin holder, namely, a rotational characteristic in constantly maintaining the desired torque for a long time, can be greatly improved and can become safer.

As a result, the endurance and the maintaining capacity for rotational torque are improved greatly and the dispersion thereof is minimized. Further, the probability for the occurrence of troubles in the rotational torque resulting from pollution of the bearing portion which is difficult to prevent and which is caused by the fly waste, dirt and dust, metal powder and the like, can be reduced to the minimum. Therefore, both the performance and economical efficiency of the bobbin holder are raised to the maximum.

Furthermore, the bobbin holder of the present invention is suitable to mass production and is easy to handle, because of having the simple construction and a few parts, and being able to reduce in the dispersion at manufacturing and to easily obtain the required accuracy.

BEST MODE FOR CARRYING OUT THE INVENTION

A bobbin holder shown as an embodiment of the present invention is swivelably, swingably, rotatably suspended and mounted to a creel for supplying a roving, of a spinning frame or a roving frame among textile machines. The outline with respect to, mainly, claim 1 is described in and by the following statement.

Figure 4A:
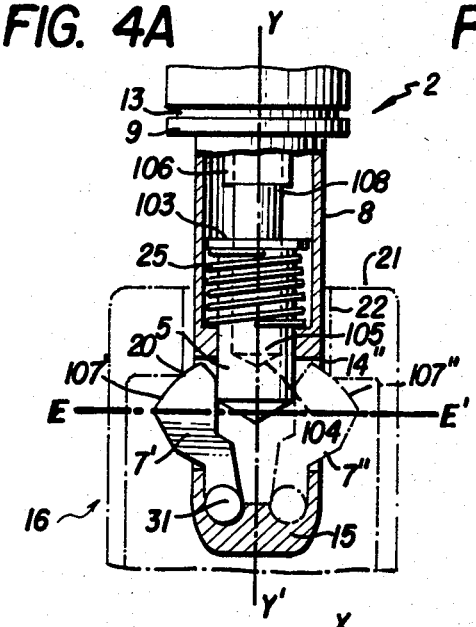
FIG. 4A and FIG. 4B correspond to FIG. 5A and FIG. 5B, respectively, and those Figures partially show the system and the states in the opening⇄closing working of rockable elements.

As shown in FIG. 4A, an inserting bore (22) of a bobbin (16) is engaged with the hanging member (2) of the bobbin holder. The bobbin (16) is inserted from the lower side. A flange of a collar (9) formed at the top of the hanging member (2) is pushed upward by means of a top end surface (21) of the bobbin (16) and the hanging member (2) is ascended at a required distance against the force of a built-in compression spring (24). Thereafter, the bobbin (16) is descended. At that time, a clutch-changing device built in the upper portion of the hanging member (2) acts instantaneously by the repulsive force of the compression spring (25), and at the same time, a core (5) which is placed in the center portion of the hanging member (2) and which has been located in an upper end, commences sliding in the abdomen of the hanging member (2) and shifts down at a high speed toward the opposite lower end. In the state where the core (5) is locking, the hanging member (2) is restored in a normal original point. At this time, a set (7) of three rockable elements (respectively, shown as (7′) (7″) (7‴)) in the hanging member (2), receives the control of the core (5) extend all together to radial directions such as three directions of ($OX_1$), ($OX_2$), ($OX_3$) from the outer surface of a cylinder of the hanging member (2). Next, the set of three rockable elements (7′) (7″) (7‴) receives the shoulder surface (20) of the bobbin (16) descending along the body (2), in the form of radial three-point support near the respective shoulder portion of a inclined slide-surface (107) (respectively, (107′) (107″) (107‴)) formed as a cone-like surface by a set of three rockable elements (7′) (7″) (7‴) which can be extended in three directions at the same angle. Therefore, the bobbin (16) is suspended in self-aligning suspension and is adapted to the draw-out speed of the roving under braking of a predetermined torque, and the center axes of the hanging member (2) and the bobbin (16) are aligned with adjusting the draw-out tension of roving. Accordingly, the bobbin (16) can be smoothly rotated in a state in which the bobbin (16) and the handing member (2) have a common vertical rotational axis (yy′).

The fundamental construction, the structure, the working and the function of a hanging member (2) according to claim 1 of the present invention are described in and by the following statement in detail.

The constituent elements are, (a): the hanging member (2) constructing a main body of a bobbin holder and containing working elements in its proper positions, (b): a core (5) for controlling the rockable elements which is inserted in the center portion of the axis of the hanging member (2) so as to concentrically slide upward and downward on a center axis (yy′) at the center of the abdomen of the hanging member (2), and a set of three rockable elements (7′) (7″) (7‴) being similar in shape rockable outward and inward with respect to a center point (O) of the hanging member (2) in the directions ($OX_1$), ($OX_2$), ($OX_3$) extended with three equal angles, (c): longitudinal guide openings (14) for guiding the rockable elements arranged radially ($OX_1$), ($OX_2$), ($OX_3$) to the axis of the hanging member (2), and provided in the place divided equally in circle of the lower portion of the hanging member (2), (d): the three similar rockable elements (7), respectively ((7′) (7″) (7‴)) which are placed with clearance in the hanging member (2) so as to project⇄draw back through the guide openings (14), (e): a changing-locking device which shifts the core (5) intermittently, reciprocally toward an upper end point and a lower end point according to the pushing-up operation of the hanging member (2) and which locks the core (5) at the both end points, in order to control the projecting-drawing back of the rockable elements, after the bobbin is inserted to the hanging member (2), and (f): the flange (9) which is provided in the upper side of a cylinder (8) of the hanging member (2), in order to push up the hanging member (2) by contacting with an upper end surface (21) of the bobbin (16).

The hanging member (2) consists of the above-mentioned six main constituent elements (a) to (f). Two compression springs (24), (25) are used in the hanging member (2) as an accumulated working energy source. The clutch-changing locking device among the above-mentioned constituent elements which is employed in the present invention with a positioning key bush (106) as a system for shifting, displacing and locking the core (5) at the two end points, is proper, sure, durable and stable. It is proved that the clutch-changing locking device is one of the elements exerting great influence on the constitution of the bobbin holder, (see FIG. 3).

Figure 4B:
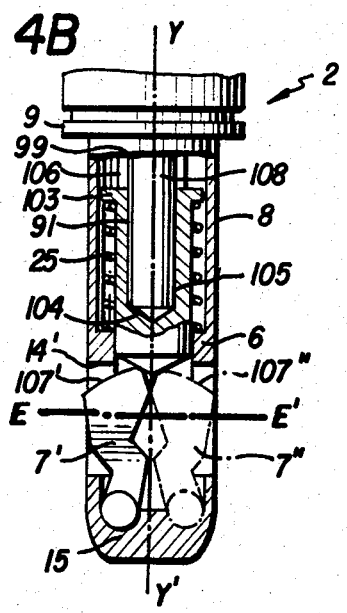
Figure 5A:
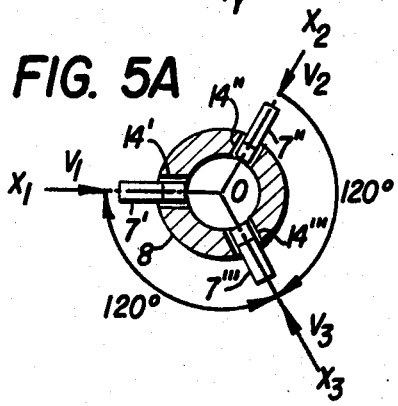
(FIG. 5 show the E—E′ section of FIG. 4 as plane views.)
Figure 5B:
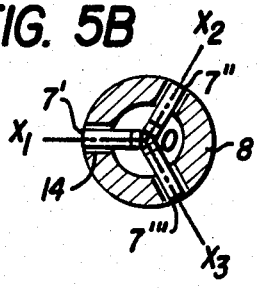

Both of FIGS. 4B and 5B show a state in which the core (5) is locked at the upper end point. FIGS. 4A and 5A show a state in which the core (5) is shifted downward and is locked at the lower end point. The state represented by FIG. 1, in which the rockable elements are opened, is the original point of one cycle of the working of the above device.

Figure 3A:
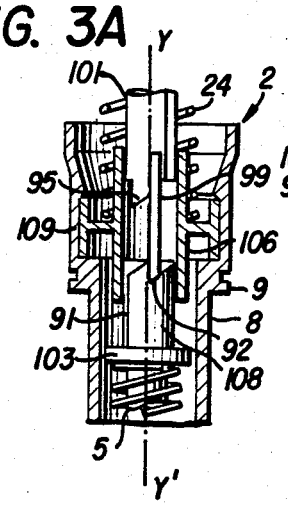
FIG. 3A, FIG. 3B and FIG. 3C show the system, the order of changing working and the changing process in a clutch-changing device which conducts the changing displacement and the locking working of a core for controlling rockable elements.
Figure 3B:
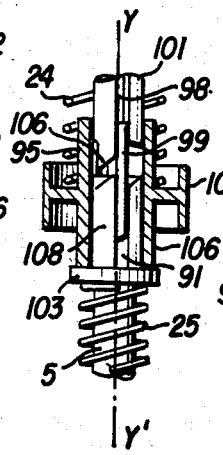
Figure 3C:
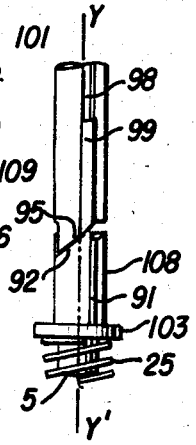

First, the bobbin (16) is inserted from the lower side of the cylinder (8) of the hanging member (2) and is pushed up. The hanging member (2) is pushed up to the upper end point thereof against the force of the built-in compression spring (24). Thereby, the core (5) corresponding to a bottom clutch (108) pushed down in order of FIG. 3B→FIG. 3C→FIG. 3A by a top clutch (101), is released from the locking between a deep groove (91) and a key provided in a key bush (106) and is immediately governed under the control of the top clutch (101). At that time, when the bobbon (16) starts to descend, the hanging member (2) descends depending on the descent of the bobbin (16). Since the top clutch (101) belongs in the different structure from that of the hanging member (2), the top clutch (101) is left from the hanging member (2) by a repulsive force of the compression spring (24), as shown in FIG. 3A. Next, a shallow groove (92) of a bottom clutch (108) is guided along to an inclined surface of a top end of a key (99) which exists in a guide groove (98) of the top clutch (101). Finally, a bottom of the next shallow groove (92) is caught by the key (99) and is locked in the state of FIG. 3A. At this time, the core (5) is shifted down to the limit of the descent and is locked, and the bobbin (16) is suspended and supported. In the drawings, (13) is a groove for engaging a snap ring, (95) is a pointed inclined tooth of the top clutch and (106) is a main pipe of the key bush. FIGS. 4A and 5A show the above-mentioned state, respectively. After that, similarly, every time the hanging member (2) is once reciprocated upward and downward, the clutch-changing locking device acts once according to the reciprocating motion of the hanging member (2). Thereby, reciprocating intermittently alternately between the upper end point and lower end point, the core (5) reciprocally circularly repeats the control for the swivel motions of concentration and projection of a set of three rockable elements (7') (7'') (7'''). (In FIG. 3, the working states are shown in detail.) According to this controlling motion, the three rockable elements (7') (7'') (7''') circularly repeat the change of functions of discharging→suspension→discharging→suspension, as shown in FIG. 4A⇄FIG. 4B, to a small diameter portion (20) of the shoulder of the bobbin (16). Thereby, the working function of donning⇄doffing to the bobbin (16), which is one of important functions of the bobbin holder according to the present invention, is achieved.

Further, the main contents of the present invention will be explained in detail.

Figure 1:
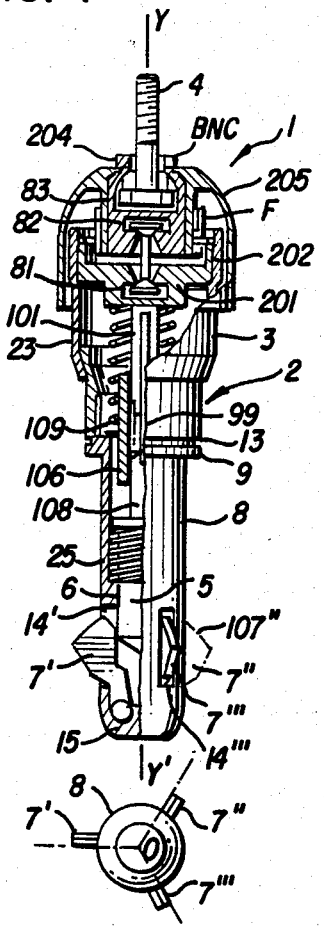
FIG. 1 is a front view showing the whole section, in an embodiment showing a fundamental structure of the bobbin holder according to the present invention. (The rockable elements are in a closed state.)

FIG. 1 shows a whole view of a constitution and a constructure of a bobbin holder according to the present invention. As shown in drawings, the core (5) is shifted up toward the upper end point. Accordingly, the three rockable elements (7') (7'') (7''') gathering concentrically together, are in a state of being entirely drawn back (shut) in a cylinder (8) and are in a state in which the bobbin (16) can be donned. In that state, by pushing up the bobbin (16) after the bobbin (16) is inserted from the lower portion of the hanging member (2), the whole hanging member (2) is raised against the force of the compression spring (24). Receiving this working, the clutch-changing device (see FIG. 3) built in the hanging member (2) commences the changing working in (B)→(C)→(A) order, and becomes an attitude of bobbin-suspension such that the rockable elements (7') (7'') (7''') extend radially as shown in FIG. 4A or FIG. 5A. That is to say, the three rockable elements (7') (7'') (7''') provided to the lower portion of the hanging member (2), form a type of a hanging construction so as to rock to open or close in the upward direction around the lower round end surfaces thereof and the round rockable bearing portion formed at the bottoms (15) of the grooves extending to the longitudinal guide openings (14') (14'') (14''') provided at the three positions of the lower portion of the cylinder (8) of the hanging member (2). Accordingly, the shift changing working of the core (5) shown in FIG. 3 is commenced by the pushing-up operation of the hanging member (2), and the core (5) is compulsorily descended concentrically with the axis (yy') of the hanging member (2), from the upper side of the set (7) of the rockable elements toward the medium of them. Therefore, while the set of three rockable elements (7') (7'') (7''') is in the state of shutting, drawing back and concentrating in the cylinder (8) and is controlled by a conical surface of the top of the core (5), the elements are rocked around each axis (31) to the boundary limited by the inner wall of the cylinder (8) under the guidance of the longitudinal guide openings (14) radiating trisectionally at the lower peripheral surface of the hanging member (2) as shown in FIGS. 4A and 5A.

Figures 6A, 6B, 6C, 6D:
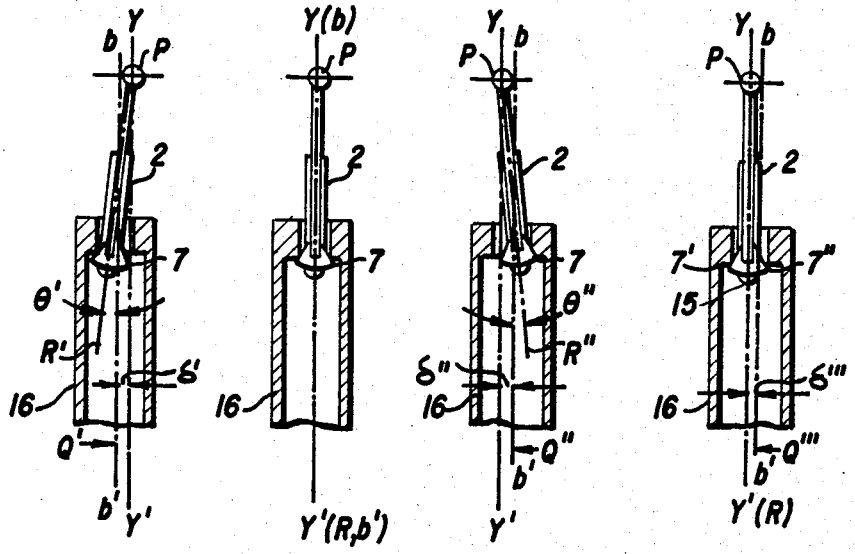
FIG. 6 is an explanatory view showing a self-aligning function and a working state in respect to a vertical suspending structure according to the present invention. (A) in FIG. 6 is an explanatory view showing an attitude of original point of restoration in self-aligning function. (B), (C) and (D) in FIG. 6, respectively, are explanatory views showing the unbalanced states in the process of the restoration.
Figure 1:
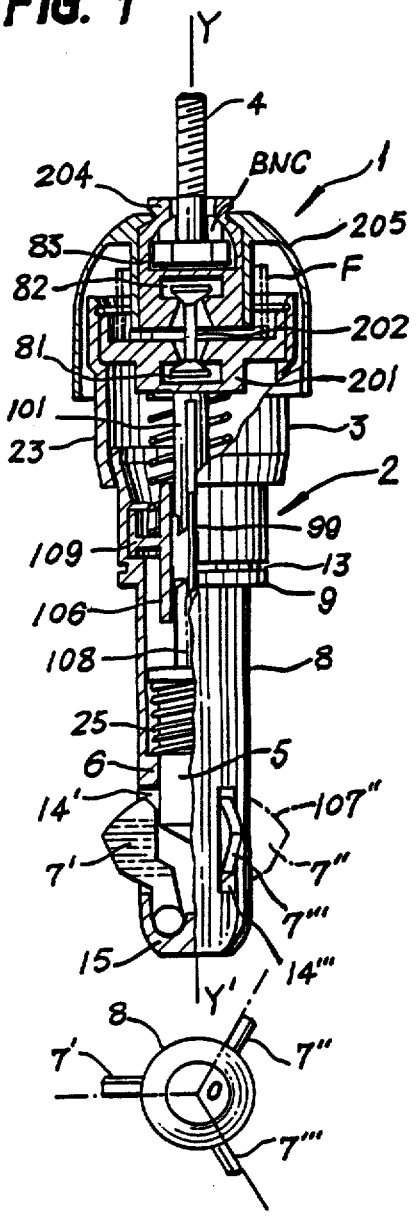
Figure 2:
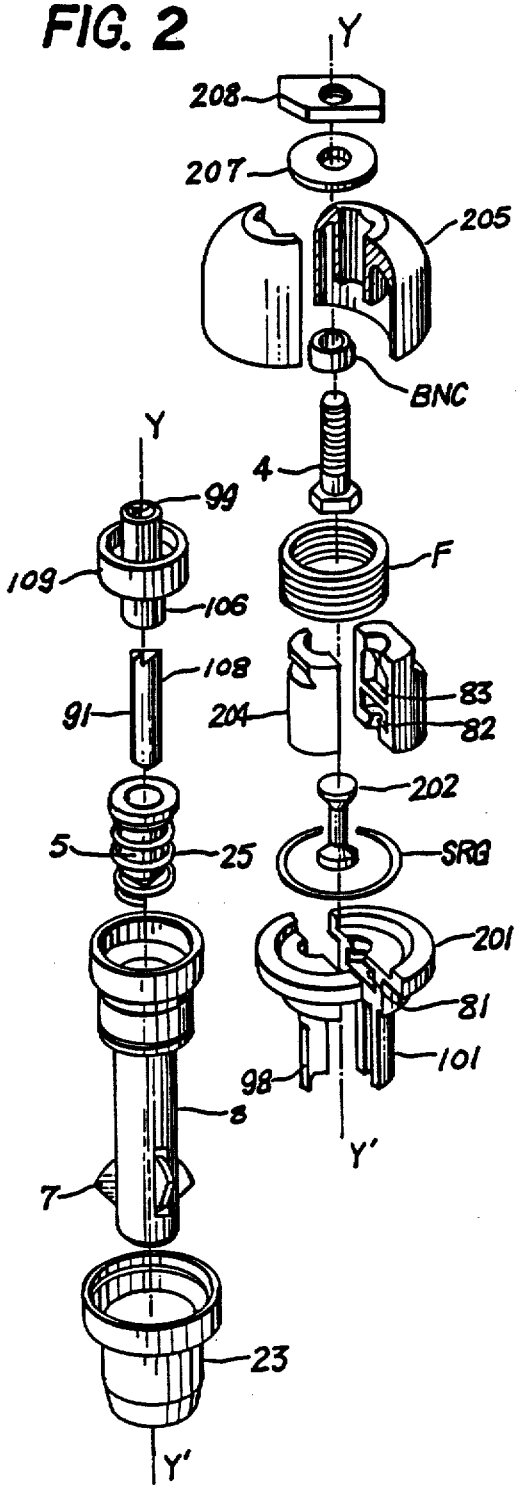
Figure 3A:
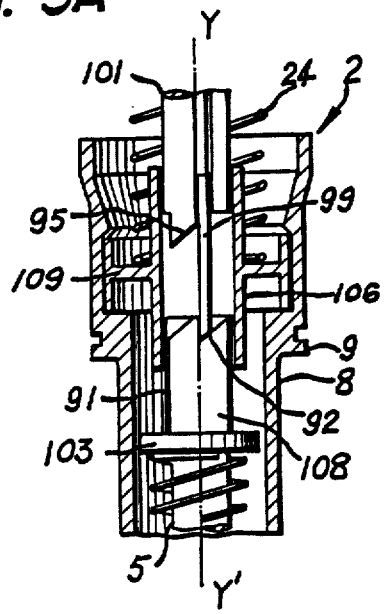
Figure 3B:
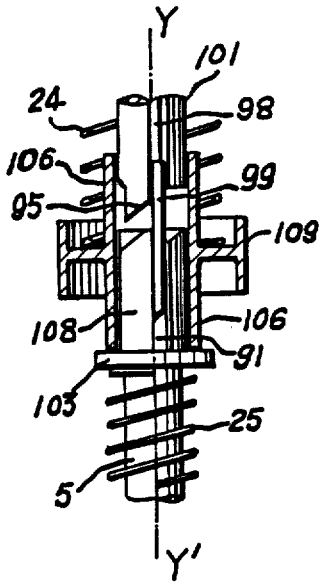
Figure 3C:
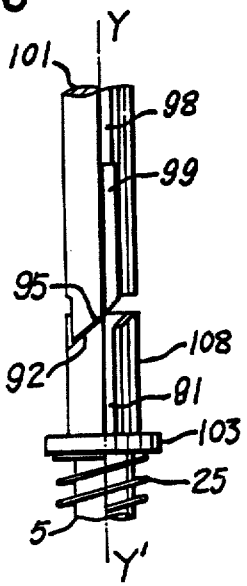
Figure 4A:
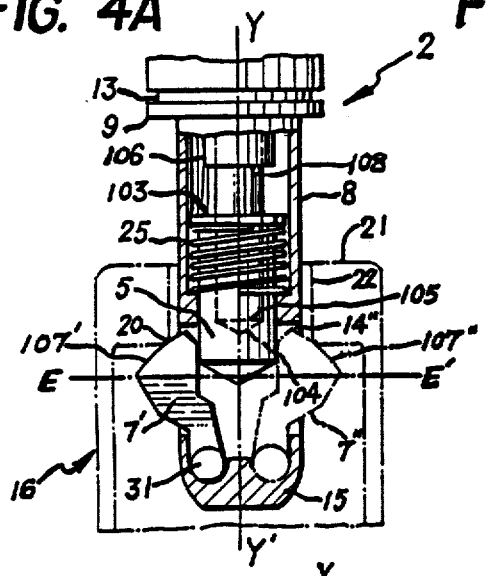
Figure 4B:
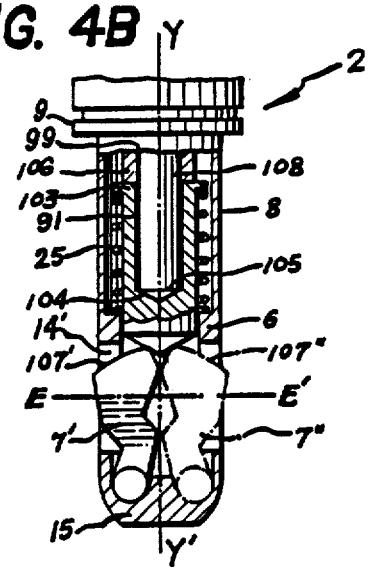
Figure 5A:
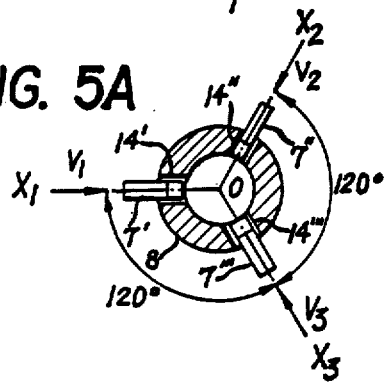
Figure 5B:
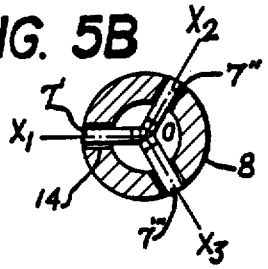
Figures 6A, 6B, 6C, 6D:
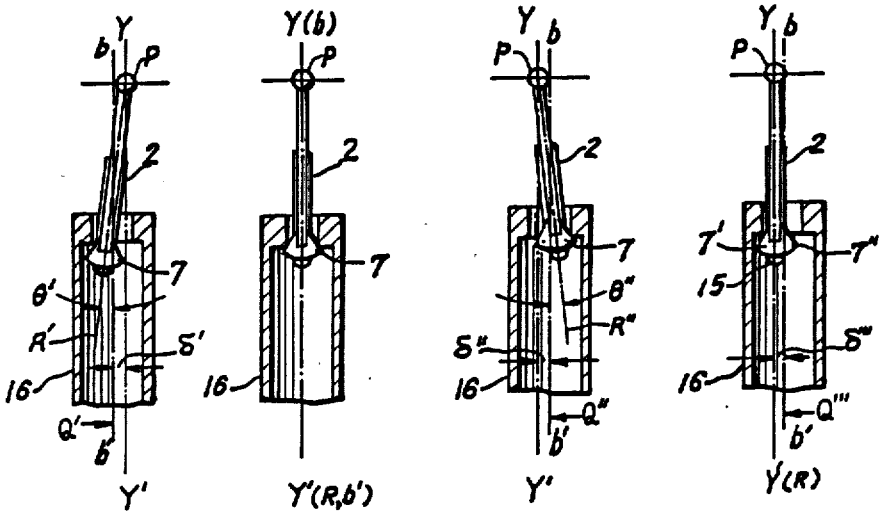

As one of the main features of the self-aligning suspension system according to the present invention with the similar three contacting points which are arranged radially ($OX_1$), ($OX_2$), ($OX_3$) with equally divided angles, it is constructed that while the situation of the loads received by each three rockable elements is maintained in the relations $V_1=V_2=V_3$, all directions of the forces are concentrated to the center axis (O) of the hanging member (2) corresponding to the axis (yy'). The forces from three directions achieve equilibrium. The relation of contacting forces at the contact points between such rockable element (7') (7'') (7''') and the core (5) is in a relation of dead-point in the direction of axis (yy'). Also, it was confirmed, as an experimental result, that the practical optimum value of the vertical angle of the inclined surface of the bobbin-suporting portion (107) which is formed in a cone-like shape in the set (7) of the rockable elements, exists between 90°-60°. Thus, the core (5) which has reached to the end point of the control action takes place at the lowest end point and is locked by the master key (99) provided to the key bush (106) fixed to the upper portion of the hanging member (2). The bobbin (16) descending along the hanging member (2), immediately after the above-mentioned situation is completed, is received to stop with the small diameter portion (20) of the shoulder of the bobbin by the inclined slide-surface (107') (107'') (107''') formed to a cone-like surface by the three rockable elements which are in the open state as shown in FIG. 4A. Receiving gravitation, immediately after the above-mentioned situation, and repeating bit by bit various balancing displacement of the contact points as shown in FIG. 6, the bobbin (16) is sensitively aligned and instantly restored to the original point (A) where is the perfect balanced state. (B), (C) and (D) of FIG. 6 respectively show the unbalanced attitudes of the bobbin (16) immediately after being suspended, and express the typical attitudes in the process of the self-aligning working. (δ) means an eccentric amount. (Each shows as (δ'), (δ'') or (δ''') respectively).

(A) in FIG. 6 shows the foundational normal suspending attitude which is in the original point. That is to say, the suspending attitude in the state that both center axes (bb') and (PR) of the bobbin (16) and the hanging member (2) are aligned and accorded together by a balancing action of the gravitation and are on a common vertical axis (yy'). Each (B), (C) and (D) of FIG. 6 shows the instantaneous change of the attitude in the process of the damping motion for restoration after receiving some external force or immediately after the completion of the bobbin-suspending-operation. (B) in those drawings shows the unbalance state that the bobbin (16) is supported by only one point of the left rockable element, and (C) shows the state with only one point of the right rockable element. Also, (D) shows the unbalance state that they are suspended in the state in which both center axes (bb') and (PR) are eccentric Though those illustrations are simplified to only two dimensions in the relation with only two rockable elements, the real aligning action in the radial three-point supporting system according to the present invention is a combined system in three dimentions and in a principle thereof, they are three-dimentionalized. In the device of the present invention, the above-mentioned unstable attitude of the bobbin which is complicatedly suspended, with inclination or eccentric unbalance, between the center axis (bb') of the bobbin (16) and the center axis (PR) of the hanging member, is not permitted even for a moment. That is to say, the restoring forces (t) and (Q) in a direction toward the original point act rapidly and dampingly due to the balancing aligning action by gravitation. The bobbin restores immediately to the state of (A) which is the original point of this device, and the normal attitude is surely kept.

Saying the relation of the construction and the functions of the core which controls opening and closing of the set (7) of the rockable elements according to the present invention, when the core (5) is separated to two pieces of a core and a bottom clutch (108) as shown in in figures and a spindle portion (105) which is the lower part of the bottom clutch (108) is supported by a step (104) of a core hole perforated to the center of the core (5) in a form of a bearing, the torque resistance can be held down to the minimum and the clutch-changing device can be operated safely and smoothly. Further, a flange (103) is formed at the top of the cylinder in the core (5) and the top surface of the spring (25) for operating the core is supported by the lower end surface of the flange. As a result, the bottom clutch (108) always resists against the spring pressure, and acts in a pressing down direction of the core (5) due to a counteraction against the above pressure. From the above-mentioned relation, the core (5) and the top clutch (101) become the following through the spindle portion (105). That is to say, the most preferable feature is constructed as mentioned below. As to the direction (yy') of the ascent and descent of the core (5), both of them act as one body entirely. As to the direction of rotating, the core (5) hardly rotates together due to the rotating resistance at the contacting surface with the spring (25). On the contrary, the bottom clutch (108) can begin the smooth rotating motion immediately.

Concerning the construction and feature of the core (5) according to the present invention, the bottom clutch (108) portion and the core (5) are formed to one body entirely.

If rockable elements are required to be held stably normally opened or normally closed when the core (5) shifts to the upper end and the set of the rockable elements is in a state that it can be closed, there are some counterplans, e.g. inserting a compression spring (or elastic elements like as foamed resins) into the center portion of the hanging member, enclosing another magnetized member, magnetizing the rockable elements per se. If those methods are considered, the above-mentioned conditions are surely satisfied and the stable operating feeling is obtained.

Figure 2:
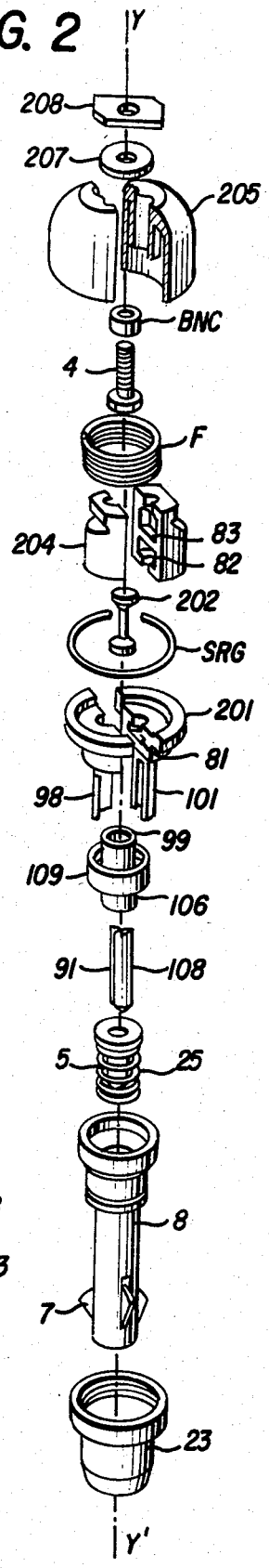
FIG. 2 is a perspective view which is in a developed form of FIG. 1, so that each element is separated according to the arrangement.

Further, in another embodiment of this invention, the rockable suspension and rotational situation in an upper structure of the bobbin holder, are formed as follows:

As shown in FIG. 1 and FIG. 2, two chambers (82) (83) are provided upper and lower portions of the center axis of a pivot housing (204) combined with a top cap (205). The ceiling portion of the inner surface of an upper first chamber (83) is formed to a spherical seating and the neck portion of a clamping bolt inserted with clearance in the first chamber (83) is formed like a hemisphere as shown in the drawings. The clamping bolt (4) and the pivot housing (204) are connected and combined by engaging a neck portion with the spherical seating suspending the same so that they can swing together in a predetermined angle range (about 5°–10°). In that case, by according the shape of the lower half portion of the inner surface of the first chamber (83) with a form of a head portion (hexagon, square, or the like) of the clamping bolt (4) and retaining some clearance for rocking at the whole periphery of the inner surface facing against the clamping bolt, a connecting relationship between the clamping bolt (4), the pivot housing (204) and the top cap (205) combined with it, can be in a limitedly connected state in which they become a stopper only in a direction of rotating, while keeping a rockably suspended state. By such a construction, a working of mounting or demounting the bobbin holder to a creel becomes very easy, and a suspending attitude of the bobbin holder as a whole can be kept ideally. Further, a lower second chamber (82) is formed to a secondary bearing portion which receives and encloses the neck portion of the upper end of a pivot (202) in a bearing form and is approximately the same as the third chamber (81) formed to a primary bearing portion. The third chamber (81) enclosing the lower end neck portion of the pivot (202) places in the center portion of the body (201) formed with a top clutch (101) in one body mounted fixedly on the rotor housing (23). The rotor housing (23) is formed so as to slidably suspend the upper periphery of the hanging member (2) from outside in the direction of the axis (yy') and to contain a spring (24). The third chamber (81) forms a primary bearing structure for rotational torque.

The double bearing structure system for rotational torque provided at the symmetric neck portions of the both ends of the bearing pivot (202) which connects the third chamber (81) with the second chamber (82) in rotatable and rockable state, provides an improvement of the capacity of the present invention. That is to say, by adjusting in principle both the draw-out resistance torques to be similar beforehand, when a sudden accident happens in the torque of the one side of them by a some cause (the invasion or pollution by fly waste, dirt, metal, sand and the like), the rotational torque value in practical use can continue at an ordinary value, so far as the other maintains a predetermined torque. On the analogy of the actual results that the bearing durability of the single slide bearing of this type passed safely the six millions rotations test under 3 kg load, it is clear that by using the development and the structure of the present invention, the reliability of a bobbin holder for textile machine has been greatly improved to a higher stage.

Further, while the above-mentioned rotor housing (23) places at the middle position between different functional structures which exist in the uppermost portion of and the lowest portion of the bobbin holder and connects for suspending them in the balanced aligning state, the rotor housing (23) composes the ordinary bearing structure part receiving the neck portion at the lower end of the pivot (202) through the top clutch fixed in the rotor housing (23). On the other hand, the rotor housing (23) guides and controls the reciprocating slide motion of the hanging member (2) at the pushing-up operation of the hanging member for starting of clutch-changing device contained in the hanging member (2). Immediately after the restoration of action, it is combined closely and keeps the aligned suspended state together. At that time, the fact that hanging member (2) and the rotor housing (23) are functionaly combined at the taper contact surface complements the self-alignment efficiency of the bobbin hanger of the present invention to a high degree.

POSSIBILITY FOR INDUSTRIAL APPLICATION

The bobbin holder according to this invention (RCH) is used as a roving holder for supply of the roving to a textile machine, beside a tri-ball-hanger (TBH) which is in relation of the sister article (inventer is the same) with the bobbin holder of this invention. Also, in a modernized textile mill, this invention has high utility value for rationalization of not only various automatic device for donning and doffing a bobbin, transferring a bobbin, distributing a bobbin, arranging a bobbin and the like, but also a series of automatic devices from case-packaging to automatic warehouse.

Further, in the other industrial field, this invention has utilized not only in an automatic device which is analogous to the above-mentioned device, but also, as examples, in a continuous automatic device in a bearing producting factory, from washing, anti-corrosive step to case-packing. This invention has a high latent possibility for automaticalization or continuatization of steps in various field.

We claim:

1. A bobbin holder comprising:

(a) an upper suspending structure;

(b) a hanging member being suspended by said upper suspending structure, being rotatable around a center axis, and being rockable with respect to said upper suspending structure;

(c) said hanging member having a cylindrical outer surface, a chamber, three guide grooves, and three rockably supporting portions;

(d) said three guide grooves opening into said chamber, extending in a direction of said axis, and being arranged radially and symmetrically with respect to said axis;

(e) three rockable elements; each rockable element having a triangle-like profile and a bottom portion supported with said each rockably supporting portion; an upper outside surface of said rockable element being formed as an inclined shoulder; and an upper inside surface of said rockable element being formed as an engaging surface, (f) said rockable elements being rockable in a limited range outwardly or inwardly around said bottom portions; in an outward position, said upper outside surfaces being arranged along a conical surface of an immaginary cone; said immaginary cone having a top angle of 60 to 90 degrees;

(g) said three rockably supporting portions formed at the bottom of said chamber, being arranged near the outer surface of the hanging member and beneath said guide grooves, in a radial and symmetric arrangement with respect to said center axis;

(h) a core member contained in said chamber; said core member being shiftable along said center axis;

(i) a control means for locking said core member in an upper shifted position or a lower shifted position;

(j) whereby, when said core member is shfited into lower position, said core member is engaged with said engaging surfaces of said rockable elements in order to hold said rockable elements opened outwardly; and when said core member is shifted into upper position, said core member is disengaged from said engaging surfaces of said rockable elements in order to allow said rockable elements to be rockable freely.

2. A bobbin holder according to claim 1, wherein said engaging surfaces of said rockable elements have straight portions and terraced portions respectively; said straight portions being parallel and symmetrically with respect to said vertical axis when said rockable elements are opened by means of insertion of said core member; and said core member has an outer cylindrical surface and a conical bottom surface.

3. A bobbin holder according to claim 1, wherein said control means is a set of rotary clutches having an upper member and a lower member;

said hanging member is divided into an upper body and a lower body;

said lower body is movable relative to said upper body along said center axis;

a first elastic member is contained in said chamber for urging said lower body downwardly;

said upper member is mounted securely on said upper body;

said lower member is movable along said center axis, and rotatable round said center axis;

said lower member is rotatably connected with said core member;

said core member is urged upwardly by a second elastic member.

4. A bobbin holder comprising:

(a) an upper suspending structure;

(b) a hanging member being suspended by said suspending structure through a pivot member;

(c) said pivot member being provided with first and second neck portions on the both ends thereof;

(d) said upper suspending structure is provided with a first bearing portion which is rotatably and rockably connected with said first neck portion of said pivot member;

(e) said hanging member being provided with said second bearing portion which is rotatably and rockably connected with said second neck portion of said pivot member;

(f) a rotational torque value between said first neck portion and first bearing portion is approximately the same as a rotational torque value between said second neck portion and said second bearing portion.

* * * * *

UNITED STATES PATENT AND TRADEMARK OFFICE

CERTIFICATE OF CORRECTION

PATENT NO. : 4,511,102

DATED : April 16, 1985

INVENTOR(S) : Tsukumo et al.

It is certified that error appears in the above-identified patent and that said Letters Patent is hereby corrected as shown below:

Please replace Figures 1, 2, 3A, 3B, 3C, 4A, 4B, 5A, 5B, 6A, 6B, 6C, and 6D with the attached sheets of formal drawings.

Signed and Sealed this

Twenty-fourth Day of March, 1987

*Attest:*

DONALD J. QUIGG

*Attesting Officer*

*Commissioner of Patents and Trademarks*